United States Patent [19]

Slavitt

[11] 4,411,077

[45] Oct. 25, 1983

[54] ATHLETIC SHOE WITH ATTACHED ANKLE BRACE

[76] Inventor: Jerome A. Slavitt, 7402 York Rd., Towson, Md. 21204

[21] Appl. No.: 337,269

[22] Filed: Jan. 5, 1982

[51] Int. Cl.[3] ..... A43B 7/14; A43B 7/20

[52] U.S. Cl. ..... 36/89; 36/128; 36/114; 128/166; 128/80 H

[58] Field of Search ..... 36/89, 128, 129, 114; 128/80 H, 166, 166.5

[56] References Cited

U.S. PATENT DOCUMENTS

| | | | |
|---|---|---|---|
| 3,534,957 | 10/1970 | Norman | 128/166 |
| 4,313,413 | 2/1982 | Cramer | 128/80 H |
| 4,323,058 | 4/1982 | Detty | 128/166 |

FOREIGN PATENT DOCUMENTS

| | | | |
|---|---|---|---|
| 827130 | 4/1938 | France | 36/89 |
| 275 | of 1903 | United Kingdom | 36/128 |
| 4364 | 1/1916 | United Kingdom | 36/89 |

*Primary Examiner*—Werner H. Schroeder
*Assistant Examiner*—Steven N. Meyers
*Attorney, Agent, or Firm*—B. P. Fishburne, Jr.

[57] ABSTRACT

Two wide equal length elastic flexible straps are cut on an angle at corresponding ends which are attached to opposite sides of an athletic shoe near the heel region where the shoe sole joins the upper. Each strap on its outer side relative to the shoe has a loop pile fastener component adjacent to the malleolus and on its opposite side adjacent to its free end has a cooperative hook fastener component. The straps in succession are drawn around the rear of the angle and lower leg under elastic tension and across the upper instep and the cooperative fastener components of each strap are pressed together into holding engagement. The two straps cross each other at the rear and front of the ankle and lower leg. A brace is formed which affords the greatest reduction in inversion and eversion of the ankle immediately adjacent to the collateral ligaments of the ankle.

2 Claims, 8 Drawing Figures

FIG. 1
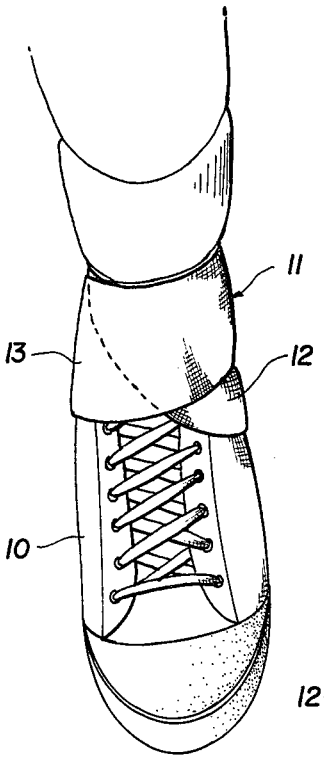
FIG. 2
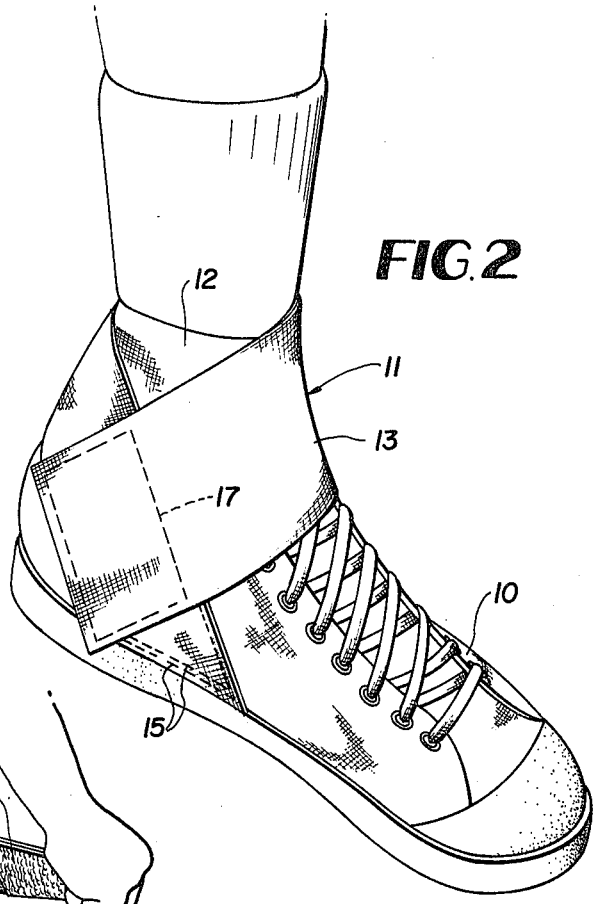
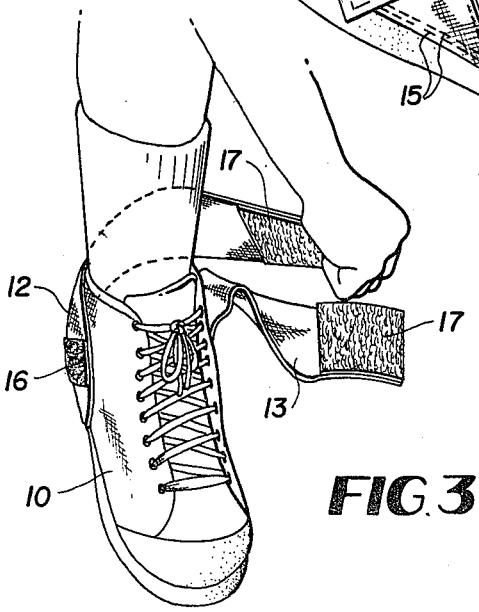
FIG. 3
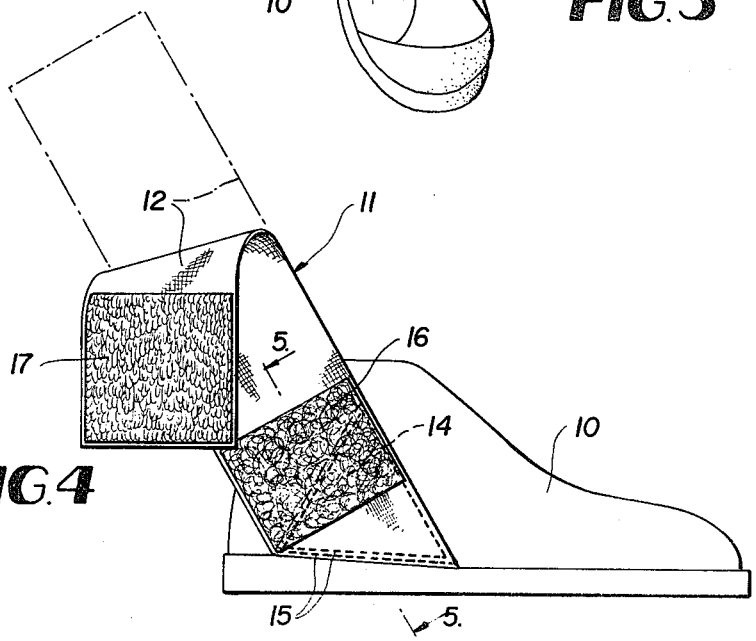
FIG. 4
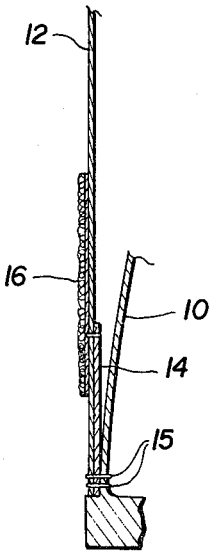
FIG. 5

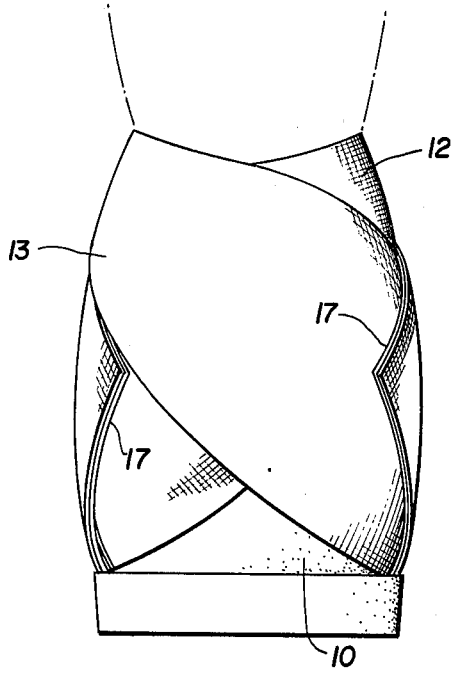
FIG. 6
FIG. 7
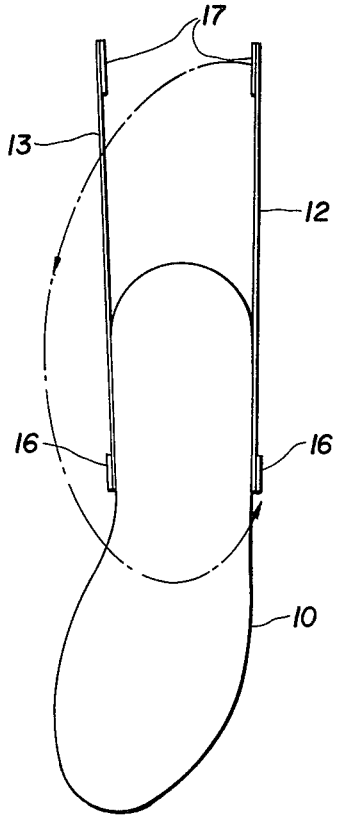
FIG. 8
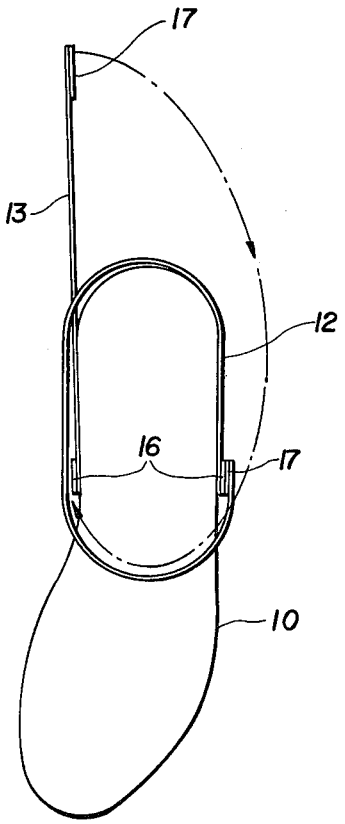

ATHLETIC SHOE WITH ATTACHED ANKLE BRACE

BACKGROUND OF THE INVENTION

U.S. Pat. No. 3,327,410 discloses an athletic shoe with an attached ankle support in the form of a strap disposed inside of the shoe upper and extending across and beneath the bottom of the foot in the region of the arch. The strap ends which are comparatively narrow are drawn around the rear of the lower leg immediately above the ankle joint and their free ends are joined by one pair of comparatively small Velcro components at the front of the lower leg near and above the ankle, one strap end having a slit through which the other strap end may be passed. In the patent, one of the Velcro components is on the exterior of one strap end and the other component is on the interior of the other strap end. In use, the shoe upper is closed after the internal brace or support is in place.

It is the objective of the present invention to provide a stronger and more effective shoe attached ankle brace for athletes, and more particularly to improve on the efficiency of operation and strength of the brace shown in the referenced prior patent.

Other objects and advantages of the invention will appear to those skilled in the art during the course of the following description.

SUMMARY OF THE INVENTION

An athletic shoe is equipped with two wide equal length externally attached elastic flexible straps. Corresponding ends of the straps are cut on an angle and attached exteriorly to opposite sides of the shoe in the malleolar region where the shoe upper meets the sole. When extended upwardly in flat planes, the straps are angled posteriorly 40 degrees to 60 degrees above the horizontal. Each strap on its outer side relative to the athletic shoe has a loop pile fastener component adjacent to the malleolus and on its opposite side adjacent to its free end has a cooperative multiple hook fastener component. The strap fastener thus formed is of the well known Velcro type.

In use, the outer strap preferably is used first due to the frequency of inversion sprains. The foot is slightly everted and the outer strap is stretched around the posterior aspect of the foot and ankle around to the medial malleous to the anterior ankle and fastened to itself through its Velcro components or patches. Following this, the interior strap is stretched in the posterior fashion around the rear of the foot and ankle across the lateral malleous and anterior ankle and fastened to itself through its Velcro components.

BRIEF DESCRIPTION OF THE DRAWINGS

FIG. 1 is a straight-on front perspective view of a shoe attached ankle brace according to the invention.

FIG. 2 is an interior side perspective view of the ankle brace shown in FIG. 1.

FIG. 3 is a further perspective view, on a reduced scale, depicting the wrapping of the outside strap around the rear of the foot and ankle.

FIG. 4 is a side elevation showing the bias cut outside strap component of the brace in an unapplied state.

FIG. 5 is an enlarged fragmentary vertical section through the shoe outside strap taken on line 5—5 of FIG. 4.

FIG. 6 is a rear elevation showing the brace in its applied state.

FIGS. 7 and 8 are partly schematic plan views depicting the manner in which the two straps forming the brace are applied around the ankle and fastened.

DETAILED DESCRIPTION

In the drawings, the invention has been illustrated in connection with a high top athletic shoe, such as a basketball shoe. It should be understood that the invention is applicable to other forms of athletic and non-athletic shoes including low top shoes and sneakers.

Referring to the drawings in detail wherein like numerals designate like parts, an athletic shoe 10, such as a high top shoe, carries an external attached ankle brace 11 in the form of two equal length wide elastic flexible straps 12 and 13, whose length may vary to accommodate a variety of leg and foot sizes. Typically, each elastic strap is $2\frac{1}{2}''$–$3''$ wide with a relaxed length of about 12".

The shoe attached end of each strap 12 and 13 is cut on an angle, as best shown in FIG. 4, so that the strap when extended upwardly in a flat plane will assume an angle in the range of 40°–60° to the horizontal. This angle cut feature is important to the most successful functioning of the brace. The angle cutting of the shoe attached ends of each strap so that each strap rises rearwardly at a steep angle from the sole of the shoe near the heel, and the subsequent tensioning and wrapping of the straps around the rear of the ankle and across the upper instep, followed by the attachment of each applied strap to itself in the malleolar region, FIG. 2, forms a brace which affords maximum reduction in inversion and eversion of the ankle, as well as maximum support for the collateral ligaments of the ankle.

The angle cut end of each strap 12 and 13 is preferably stiffened and reinforced on its interior side, FIG. 5, by a fabric layer 14 which may be triangular, as shown in dotted lines in FIG. 4. This reinforcement and the bias cut end of each elastic strap is permanently and strongly attached to the shoe at the region where the shoe upper joins the sole by lines of stitching 15, or equivalent means. The lines of attachment of the straps to the shoe at the opposite sides of the shoe are in the malleolar region.

Each strap 12 and 13 carries two large preferably rectangular mating Velcro components or patches 16 and 17 near its opposite ends with the patches preferably spanning the entire width of the strap. The loop pile component 16 of each strap is on the outer surface of the strap immediately above the stitching 15 and at the outside of the ankle joint or malleolar region. The mating multiple component 17 is attached to the inner side of the same strap adjacent to the free end of the strap, as shown.

In the use of the ankle brace embodied in the two elastic straps 12 and 13, the objective of the device is to stabilize the lateral and medial ligaments of the foot, i.e., anterior talo fibular, calcaneal fibular, posterior talo fibular, and the deltoid ligaments. The external disposition of the brace avoids compression syndrome frequently caused by internal figure-8 wraps with adhesive tape or the like. Also, the use of adhesives is avoided to eliminate contact dermatitis.

In applying the ankle brace, the outside strap 12 is generally used first due to the greater frequency of inversion sprains. With the foot slightly everted, the outside strap is grasped as shown in FIG. 3, stretched and turned around the posterior aspect of the foot and ankle around to the medial malleous to the anterior ankle and fastened to itself through the coaction of its two fastener components 16 and 17. More particularly, the interior component 17 is pressed into holding engagement with the exterior component 16. This forms a first strong anchor for the brace at the exterior malleolar region.

Following this, the second strap 13 on the medial side of the shoe is grasped and stretched and pulled around the posterior aspect of the foot and ankle in the opposite direction to the first strap 12 and in overlapping crossing relationship therewith at the rear of the shoe, as clearly shown in FIG. 6. The second strap is further pulled forwardly across the lateral malleous and anterior ankle and fastened to itself by engagement of the Velcro components 16 and 17. This action forms a second strong anchor for the brace at the inner side of the ankle and directly opposite from the anchor formed by the fastener components 16 and 17 of the first or outside elastic strap 12. As best shown in FIG. 1, the two straps also cross each other and overlap at the front of the ankle and the ankle is braced or immobilized in all directions. The bracing force is concentrated adjacent to the malleolus and the collateral ligaments of the ankle, well rearwardly of the mid-foot area.

The described method of use shown pictorially in FIGS. 1–3 and 6 is also shown schematically in FIGS. 7 and 8. In these two figures, the straps 12 and 13 in relaxed or unstretched states prior to use are shown in FIG. 7. In FIG. 8, after grasping and stretching the outside strap 12, it is applied around the back of the ankle and across the front and fastened to itself by components 16 and 17, as described. Following this, the second strap 13 is stretched and applied in the opposite direction as represented by the phantom line with arrows.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. An ankle brace for an athletic shoe adapted to afford maximum reduction in inversion and eversion of the ankle joint and reinforcement of the collateral ligaments of the ankle, comprising a pair of wide substantially equal length elastic flexible straps, corresponding ends of the straps being cut on an angle to the longitudinal axis of the straps and the cut ends of the straps being attached to the opposite sides of an athletic shoe near the heel and adjacent to the connection between the shoe sole and upper at posterior angles relative to the plane occupied by the shoe sole, the cut ends of the straps being substantially parallel to the shoe sole, whereby the straps when extended upwardly from the sole assume steeply inclined posterior angles, and cooperative hook and loop pile fastener components on the opposite end portions of each strap, one component being on the exterior of each strap with relation to the athletic shoe near and above the angle cut end of the strap and adjacent to the malleolus, and the other fastener component being on the opposite side of each strap adjacent to the free end portion of the strap, whereby each strap in succession can be stretched and drawn upwardly and rearwardly at a steep posterior angle above the shoe sole and wrapped transversely around the rear of the ankle and lower leg and then drawn forwardly and wrapped transversely in the opposite direction across the top of the instep and lower leg and then secured in a bracing position through engagement of the two fastener components of each strap one upon the other.

2. An ankle brace for an athletic shoe comprising a pair of opposite side elastic and flexible bracing straps for the shoe each having corresponding ends cut on an angle to the longitudinal axis of the strap, means attaching each cut end of the straps to the athletic shoe near the heel and near the connection of the heel with the shoe upper at posterior angles relative to the plane occupied by the shoe sole, whereby the straps when extended from their connected ends will assume posterior angles of inclination, and cooperative fastener components on the opposite end portions of the straps, one fastener component being on the exterior of each strap relative to the shoe near and above the attached end of the strap and being adjacent to the malleolus, and the other fastener component being on the other side of each strap near its free end portion.

* * * * *